US006670314B2

(12) United States Patent
Smith et al.

(10) Patent No.: US 6,670,314 B2
(45) Date of Patent: Dec. 30, 2003

(54) DISHWASHING METHOD

(75) Inventors: David John Smith, Hett (GB); Sanjeev Sharma, New Castle upon Tyne (GB); James Iain Kinloch, Cramlington (GB); Simon John Greener, North Shields (GB)

(73) Assignee: The Procter & Gamble Company, Cincinnati, OH (US)

( * ) Notice: Subject to any disclaimer, the term of this patent is extended or adjusted under 35 U.S.C. 154(b) by 198 days.

(21) Appl. No.: 09/994,564

(22) Filed: Nov. 27, 2001

(65) Prior Publication Data

US 2002/0142930 A1 Oct. 3, 2002

(30) Foreign Application Priority Data

Nov. 27, 2000 (GB) ..... 0028821
Nov. 14, 2001 (GB) ..... 0127283
Nov. 21, 2001 (GB) ..... 0127812

(51) Int. Cl.[7] ..... C11D 3/60
(52) U.S. Cl. ..... 510/220; 510/221; 510/424; 222/103; 222/105
(58) Field of Search ..... 510/220, 221, 510/424; 222/103, 105

(56) References Cited

U.S. PATENT DOCUMENTS

| | | | | |
|---|---|---|---|---|
| 3,218,776 | A | | 11/1965 | Cloud |
| 3,502,487 | A | | 3/1970 | Byrd |
| 3,528,921 | A | | 9/1970 | Gray |
| 3,705,102 | A | | 12/1972 | Mast |
| D234,751 | S | | 4/1975 | Brodsky |
| 4,115,292 | A | | 9/1978 | Richardson et al. |
| 4,154,636 | A | | 5/1979 | Motoyama et al. |
| 4,162,987 | A | | 7/1979 | Maguire, Jr. et al. |
| 4,176,079 | A | | 11/1979 | Guerry et al. |
| 4,416,791 | A | | 11/1983 | Haq |
| 4,622,161 | A | | 11/1986 | Cornelissens et al. |
| 4,747,976 | A | | 5/1988 | Yang et al. |
| 4,753,748 | A | * | 6/1988 | Laitem et al. |
| 4,776,455 | A | | 10/1988 | Anderson et al. |
| 4,818,427 | A | | 4/1989 | Altenschoepfer et al. |
| 4,828,744 | A | | 5/1989 | Kaufmann et al. |
| 4,885,105 | A | | 12/1989 | Yang et al. |
| 4,929,380 | A | | 5/1990 | Schulz et al. |
| 4,973,416 | A | | 11/1990 | Kennedy |
| 5,015,513 | A | | 5/1991 | Newbold et al. |
| 5,110,641 | A | | 5/1992 | Kean |
| 5,132,036 | A | | 7/1992 | Falou et al. |
| 5,141,664 | A | | 8/1992 | Corring et al. |
| 5,146,730 | A | | 9/1992 | Sadek et al. |
| 5,160,654 | A | | 11/1992 | Falou et al. |
| 5,224,601 | A | | 7/1993 | Gouge et al. |

(List continued on next page.)

FOREIGN PATENT DOCUMENTS

| | | | |
|---|---|---|---|
| CA | 1112534 | | 11/1981 |
| DE | 100 03 429 | A1 | 9/2000 |
| DE | 199 61 661 | A1 | 12/2000 |
| EP | 0 132 726 | A2 | 2/1985 |
| EP | 0 261 754 | A2 | 3/1988 |
| EP | 0 261 754 | B1 | 9/1991 |
| EP | 0 479 404 | A2 | 4/1992 |
| EP | 0 608 910 | B1 | 6/1997 |
| EP | 0846 757 | A2 | 6/1998 |
| EP | 0 879 874 | A2 | 11/1998 |
| EP | 0 879 874 | A3 | 11/1998 |
| EP | 0 879 874 | A3 | 6/1999 |
| EP | 1 126 070 | A1 | 8/2001 |
| EP | 0889 710 | B1 | 2/2002 |
| EP | 0 889 710 | B1 | 2/2002 |
| GB | 2 361 687 | A | 10/2001 |
| WO | WO 92/17382 | A1 | 10/1992 |
| WO | WO 94/14941 | A1 | 7/1994 |
| WO | WO 96/24328 | A1 | 8/1996 |
| WO | WO 97/35537 | A1 | 10/1997 |
| WO | WO 98/30670 | A2 | 7/1998 |
| WO | WO 00/02980 | A3 | 1/2000 |
| WO | WO 00/02980 | A2 | 1/2000 |
| WO | WO 00/55068 | A1 | 9/2000 |
| WO | WO 01/79417 | A1 | 10/2001 |
| WO | WO 02/08371 | A2 | 1/2002 |
| WO | WO 02/08376 | | 1/2002 |
| WO | WO 02/14460 | A2 | 2/2002 |
| WO | WO 02/16205 | A1 | 2/2002 |
| WO | WO 02/16206 | A1 | 2/2002 |
| WO | WO 02/16207 | A1 | 2/2002 |
| WO | WO 02/16222 | A1 | 2/2002 |
| WO | WO 02/16541 | A1 | 2/2002 |
| WO | WO 02/060757 | A2 | 8/2002 |
| WO | WO 02/060758 | A1 | 8/2002 |
| WO | WO 02/074891 | A2 | 9/2002 |
| WO | WO 02/074891 | A3 | 9/2002 |
| WO | WO 02/074892 | A1 | 9/2002 |
| WO | WO 02/085707 | A1 | 10/2002 |
| WO | WO 02/085736 | A1 | 10/2002 |
| WO | WO 02/085737 | A1 | 10/2002 |
| WO | WO 02/085738 | A1 | 10/2002 |

OTHER PUBLICATIONS

The Procter & Gamble Company, Trademark Application No. 001917483, Danièle Le Carval, Filed Oct. 19, 2000.

The Procter & Gamble Company, Trademark Application No. 002040897, Danièle Le Carval, Filed Jan. 15, 2001.

*Primary Examiner*—Gregory E. Webb
(74) *Attorney, Agent, or Firm*—Jeffrey V. Bamber

(57) ABSTRACT

A method of washing dishware/tableware in an automatic dishwashing machine having a single or multi-compartment product dispenser which is normally closed and sealed after charging the machine and prior to delivery of the dishwashing product into the wash liquor and wherein the dishwashing product comprises one or more dishwashing compositions in a unit dose form having a degree of deformability greater than about 10% and a shape and size such that the dishwashing product occupies more than about 60%, preferably more than about 85% of the volume of the corresponding compartment of the product dispenser in its closed state. The method allows for optimum delivery of active components across different washing machine types.

26 Claims, No Drawings

U.S. PATENT DOCUMENTS 5,248,038 A 9/1993 Hodakowski et al.
5,272,191 A 12/1993 Ibrahim et al.
D343,573 S 1/1994 Shadrach et al.
5,280,835 A 1/1994 Edwards et al.
5,328,025 A 7/1994 Hodakowski et al.
5,330,047 A 7/1994 Gouge et al.
5,336,430 A 8/1994 Bahary et al.
5,351,831 A 10/1994 Gouge et al.
5,362,532 A 11/1994 Famili et al.
5,384,364 A 1/1995 Besse et al.
5,394,990 A 3/1995 Edwards et al.
5,395,616 A 3/1995 Edwards et al.
5,395,617 A 3/1995 Edwards et al.
5,403,589 A 4/1995 Edwards et al.
5,407,680 A 4/1995 Edwards et al.
5,419,909 A 5/1995 Edwards et al.
5,422,113 A 6/1995 Edwards et al.
RE34,988 E 7/1995 Yang et al.
5,429,242 A 7/1995 Edwards et al.
5,429,874 A 7/1995 VanPutte
5,464,097 A 11/1995 Edwards et al.
5,516,562 A 5/1996 Edwards et al.
5,540,989 A 7/1996 Maul et al.
5,624,034 A 4/1997 Edwards et al.
5,806,285 A 9/1998 Rizzieri
5,827,586 A 10/1998 Yamashita et al.
5,830,543 A 11/1998 Miyake et al.
5,863,885 A 1/1999 Ruggieri et al.
5,914,368 A 6/1999 Haschke et al.
5,929,007 A 7/1999 Feng
6,037,319 A 3/2000 Dickler et al.
6,089,374 A 7/2000 Edwards et al.
6,090,771 A 7/2000 Burt et al.
6,124,036 A 9/2000 Brown et al.
6,133,214 A 10/2000 Jung et al.
6,136,776 A 10/2000 Dickler et al.
6,193,058 B1 2/2001 Yacko et al.
6,228,825 B1 5/2001 Gorlin et al.
6,244,746 B1 6/2001 Tokita et al.
D445,673 S 7/2001 Richardson
D445,675 S 7/2001 Richardson
6,281,183 B1 8/2001 Harbour
6,303,553 B1 10/2001 Gorlin
D451,795 S 12/2001 Ghatlia et al.
D452,143 S 12/2001 Ghatlia et al.
6,363,693 B1 4/2002 Edwards et al.
6,378,274 B1 4/2002 Harbour
6,451,750 B2 9/2002 Hewitt et al.
6,465,408 B1 10/2002 Lee et al.
6,465,413 B1 10/2002 Hinton
6,475,975 B1 11/2002 Kinscherf et al.
6,475,977 B1 11/2002 Pfeiffer et al.
6,479,448 B2 11/2002 Cropper et al.
6,479,449 B1 11/2002 Mondin
6,482,785 B1 11/2002 Mondin
6,486,109 B1 11/2002 Mondin
6,486,116 B1 11/2002 Hinton
6,492,312 B1 12/2002 Pfeiffer et al.
6,495,503 B1 12/2002 Zappone et al.
6,495,504 B1 12/2002 Schramm, Jr. et al.
6,495,505 B1 12/2002 Reul et al.
2001/0026792 A1 10/2001 Farrell et al.
2001/0031714 A1 10/2001 Gassenmeier et al.
2002/0004472 A1 1/2002 Holderbaum et al.
2002/0004473 A1 1/2002 Busch et al.
2002/0013232 A1 1/2002 Kinoshita et al.
2002/0013242 A1 1/2002 Baillely et al.
2002/0013243 A1 1/2002 Hewitt et al.
2002/0026771 A1 3/2002 Brown
2002/0028756 A1 3/2002 Carter et al.
2002/0033004 A1 3/2002 Edwards et al.
2002/0045559 A1 4/2002 Forth et al.
2002/0055449 A1 5/2002 Porta et al.
2002/0086806 A1 7/2002 Giblin et al.
2002/0094942 A1 7/2002 Danneels et al.
2002/0115583 A1 8/2002 Lant et al.
2002/0119903 A1 8/2002 Lant et al.
2002/0123443 A1 9/2002 Bennie et al.
2002/0123444 A1 9/2002 Fisher et al.
2002/0137648 A1 9/2002 Sharma et al.
2002/0142930 A1 10/2002 Smith et al.
2002/0142931 A1 10/2002 DeNome et al.
2002/0166779 A1 11/2002 Etesse et al.
2002/0169092 A1 11/2002 Catlin et al.
2002/0169095 A1 11/2002 Forth et al.
2002/0198125 A1 12/2002 Jones

* cited by examiner

DISHWASHING METHOD

TECHNICAL FIELD

The present invention is in the field of dishwashing, in particular it relates to dishwashing methods including methods for washing dishware/tableware in an automatic dishwashing machine using dishwashing products in unit dose and especially pouch form. The methods of the invention are especially useful for the removal of cooked-, baked- and burnt-on soils from cookware and tableware.

BACKGROUND OF THE INVENTION

Unitised doses of dishwashing detergents are found to be more attractive and convenient to some consumers because they avoid the need of the consumer to measure the product thereby giving rise to a more precise dosing and avoiding wasteful overdosing or underdosing. For this reason automatic dishwashing detergent products in tablet form have become very popular. Detergent products in pouch form are also known in the art.

It is normally the objective of the detergent formulator chemist to optimise the amount of actives delivered to the wash for a given unit cost. The amount of actives delivered to the wash is, among other factors, determined by the shape, size and density of the unitised dose form.

One of the drawbacks of unitised dose form such as tablets is that they have a fixed shape. The shape of dishwashing machine dispensers, on the other hand, is different from manufacturer to manufacturer. Tablets are designed to have a size and shape which fit all machine dispensers, this fact together with the mechanical properties of tablets usually constrains the amount of product composition which can be incorporated in the tablet. Similar considerations can also apply in the case of detergent products in pouch form.

Another drawback of detergent tablets is the fact that their manufacturing process requires the additional step of powder compaction. This slows down the dissolution rate of the ingredients forming the tablet, or requires the use of complex and expensive disintegrant systems, or makes it difficult to achieve differential dissolution of the detergent active ingredients.

Another factor that can contribute to the inefficient delivery of actives to the wash, in the case of tablets, is the need for adding carrier materials, as for example porous materials able to bind active liquid materials, binders and disintegrants. In particular, the incorporation of liquid surfactants to powder form detergent compositions can raise considerable processing difficulties and also the problem of poor dissolution through the formation of surfactant gel phases.

There is still the need for a unitised dose form which allows for optimum delivery of active components across different washing machine types and which provides improved processing and dissolution characteristics.

SUMMARY OF THE INVENTION

According to a first aspect of the present invention, there is provided a method of washing dishware/tableware in an automatic dishwashing machine having a single or multi-compartment product dispenser which is normally closed and sealed after charging the machine and prior to delivery of the dishwashing product into the wash liquor and wherein the dishwashing product comprises one or more dishwashing compositions in a unit dose form. The unit dose forms used herein are deformable and preferably have a shape and size such that they are compressibly contained within the product dispenser. The dishwashing product has a deformability, as measured following the method described hereinbelow of greater than about 5%, preferably greater than about 8%, more preferably greater than about 10% and even more preferably greater than about 20%. The shape and size of the product are also such that it occupies at least about 60%, preferably at least about 70%, more preferably at least about 80%, especially more than about 85% of the volume of the corresponding compartment of the product dispenser in its closed state. Provided that in the case of single compartment dispensers the dishwashing product can occupy at least about 40%, preferably at least about 50% of the volume of the product dispenser compartment in its closed state. The term "compressibly contained" as used herein means that the product is in a state of compression within the closed product dispenser across at least one transverse section of the product. Preferably the product is in a state of compression across the smallest transverse section of the product in a direction generally perpendicular to the product dispenser closure means.

The deformability of the unit dose form may be measured using an Instrom materials tester (or similar) according to the following procedure. The unit dose form is placed on a flat surface such that it lies on a base of maximum footprint and a corresponding flat probe is brought down upon the upper surface of the unit dose form. The movement of the probe is continued until a sufficient reaction force is created to cause the unit dose form to fracture or burst. The deformability of the unit dose form may be defined as:

$$\left\{\frac{\text{displacement of probe after touching unit dose form up to burst point}}{\text{total unit dose form thickness}}\right\}\times 100$$

The volume of the unit-dose containing product dispenser compartment in its closed state lies in the range from about 15 to about 70, preferably from about 18 to 50 and more preferably from about 20 to 30 ml. In the case of multi-compartment dispensers, the individual compartments generally have a volume of from about 10 to about 35 ml, preferably from about 15 to about 30 ml. The total volume of the product dispenser (both multi and single compartments) on the other hand is generally from about 20 to about 70 ml, preferably from about 30 to about 50 ml.

The deformability herein is measured when the unit dose form is resting on its maximum footprint. The deformability measured when the pouch is placed in this position is sometimes referred to herein as "vertical deformability". The deformability measured when the unit dose form is rotated into a perpendicular plane is referred herein as "horizontal deformability". In preferred embodiments the unit doses have differing vertical and horizontal deformability (so-called anisotropic deformability), the vertical and minimum horizontal deformability in the perpendicular plane preferably differing from each other by at least about 30% preferably at least about 40%. It is also preferred that the minimum horizontal deformability is greater than the vertical deformability. Anisotropic deformability is preferred herein from the dispenser fit, packaging and the feel and handling viewpoints.

The term "unit dose" herein refer to a dose of detergent product incorporating one or more dishwashing compositions and sufficient for a single wash cycle. Suitable unit dose forms include capsules, sachets and pouches which can have single or multiple compartments. Suitable unit dose forms for use herein include water-soluble, water-dispersible and water-permeable capsules, sachets and pouches. Preferred for use herein are water soluble pouches, based on partially hydrolysed polyvinyl alcohol as pouch material. Dishwashing compositions incorporated therein can be in liquid, gel, paste or pouch form, but preferably composition in liquid gel or paste form are substantially anhydrous for reasons of pouch stability.

In a preferred aspect of the invention, dishwashing product comprises a dose sufficient for a single wash cycle of an anhydrous dishwashing composition. The term anhydrous as used herein is intended to include compositions containing less than about 10% of water by weight of the composition, preferably less than about 5% of water and more preferably less than about 1%. The water can be present in the form of hydrated compounds, i.e. bound water or in the form of moisture. It is preferred that the composition contains less than about 1%, preferably less than about 0.1% free moisture. Free moisture can be measured by extracting 2 g of the product into 50 ml of dry methanol at room temperature for 20 minutes and then analysis a 1 ml aliquot of the methanol by Karl Fischer titration.

In preferred embodiments the dishwashing composition comprises an organic solvent system. The organic solvent system can simply act as a liquid carrier, but in preferred compositions, the solvent can aid removal of cooked-, baked- or burnt-on soil and thus has detergent functionality in its own right. The organic solvent system (comprising a single solvent compound or a mixture of solvent compounds) preferably has a volatile organic content above 1 mm Hg and more preferably above 0.1 mm Hg of less than about 50%, preferably less than about 20% and more preferably less than about 10% by weight of the solvent system. Herein volatile organic content of the solvent system is defined as the content of organic components in the solvent system having a vapor pressure higher than the prescribed limit at 25° C. and atmospheric pressure.

The organic solvent system for use herein is preferably selected from organoamine solvents, inclusive of alkanolamines, alkylamines, alkyleneamines and mixtures thereof; alcoholic solvents inclusive of aromatic, aliphatic (preferably $C_4$–$C_{10}$) and cycloaliphatic alcohols and mixtures thereof; glycols and glycol derivatives inclusive of $C_2$–$C_3$ (poly)alkylene glycols, glycol ethers, glycol esters and mixtures thereof; and mixtures selected from organoamine solvents, alcoholic solvents, glycols and glycol derivatives. In one preferred embodiment the organic solvent comprises organoamine (especially alkanolamine) solvent and glycol ether solvent, preferably in a weight ratio of from about 3:1 to about 1:3, and wherein the glycol ether solvent is selected from ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol monobutyl ether, and mixtures thereof. Preferably, the glycol ether is a mixture of diethylene glycol monobutyl ether and propylene glycol butyl ether, especially in a weight ratio of from about 1:2 to about 2:1.

In another embodiment of the invention, the anhydrous dishwashing composition is in the form of a particulate bleach suspension in a non-aqueous liquid carrier. Preferred liquid carriers comprises at least about 50%, preferably at least about 60% and more preferable at least 90% of a solvent or solvent mixture having:

i) a fractional dispersion Hansen solubility parameter greater than about 40%, preferably greater than about 60% and more preferably greater than about 80%; and ii) a fractional polar Hansen solubility parameter less than about 60%, preferably less than about 40% and more preferably less than about 20%.

Fractional dispersion Hansen solubility parameter of a solvent is defined as the ratio (multiplied by 100) of the dispersion Hansen solubility parameter to the sum of the dispersion, polar and hydrogen bonding Hansen solubility parameters. Fractional polar Hansen solubility parameter of a solvent is accordingly defined.

Solvents having the fractional Hansen solubility parameters described hereinabove are particularly valuable for purposes of bleach stability. These solvents have very low water absorption, this is particularly important in cases wherein the bleach is contained in pouches, because apart from the problem of loss of bleach, bleach decomposition gives rise to oxygen gas which can cause bloating of the pouch material and give the pouches a fluffy appearance (not very attractive to the consumers). Particulate bleaches suitable for use herein include inorganic peroxides inclusive of perborates and percarbonates, organic peracids inclusive of preformed monoperoxy carboxylic acids, such as phthaloyl amido peroxy hexanoic acid and di-acyl peroxides. Preferred peroxides for use herein are percarbonate and perborate bleach.

One problem in formulating particulate bleach into liquid compositions is to keep the bleach physically stable and homogeneously distributed in the liquid composition. Bleach suspension can be achieved by matching the density of the liquid carrier and the particulate bleach. To this end, the density difference between the particulate bleach and the non-aqueous liquid carrier is preferably less than about 500 $Kg/m^3$, more preferably less than about 300 $Kg/m^3$. High viscosity and small particle size will also contribute to the formation of a stable suspension. In one embodiment of the present invention, the particulate bleach has an average particle size from about 10 $\mu$m to about 500 $\mu$m, preferably from about 30 $\mu$m to about 250 $\mu$m, as measured using a Malvern particle size analyser based on laser diffraction. The suitable viscosities for the suspensions of the invention are from about 1,000 $Kg/m\ s^{-1}$ to about 100,000 $Kg/m\ s^{-1}$, preferably from about 5,000 $Kg/m\ s^{-1}$ to about 50,000 $Kg/m\ s^{-1}$ at shear rate of 1 $s^{-1}$; and from about 500 $Kg/m\ s^{-1}$ to about 50,000 $Kg/m\ s^{-1}$, preferably from about 800 $Kg/m\ s^{-1}$ to about 30,000 $Kg/m\ s^{-1}$ at shear rate of 150 $s^{-1}$ as measured using a Contraves Rheometer with 40 mm diameter parallel plate at 25° C.

In preferred embodiments the dishwashing composition included in the unit dose form of the invention comprises a detersive enzyme. In another embodiment the dishwashing composition comprises an alkalinity source.

According to another aspect of the invention there is provided a unit dose dishwashing detergent composition in the form of a paste having a density greater than about 1100 $Kg/m^3$, preferably greater than about 1300 $Kg/m^3$.

Multi-compartment pouches suitable for use herein can include compartments with different solubilities controlled by for example pH, temperature or any other means. High temperature soluble pouches allow the handling of the pouches at ambient temperature with wet hands.

Unitised doses having multi-compartments can comprise at least one compartment containing a powder composition. This powder composition comprises traditional solid materials used in dishwashing detergent, such as builders, alkalinity sources, bleaches, etc. Especially useful are multi-compartment unit dose forms comprising different compartments for solid and for liquid compositions. The liquid compositions comprise traditional liquid materials used in dishwashing detergents, such as non-ionic surfactants or the organic solvents described hereinabove. Especially useful liquids for use in the case of multi-compartment unit dose forms comprising a powder compartment and a liquid compartment are liquids with hygroscopic and hydrophilic properties because they are capable to act as a moisture sink and reduce moisture pick-up by the powder compartment.

DETAILED DESCRIPTION OF THE INVENTION

The present invention envisages the use of dishwashing detergent composition in unit dose form, which have a high degree of deformability. This allow optimal use of the dishwashing machine dispenser, without loosing the convenience of unit dose form. The invention also envisages the use of single and multi-compartment unit dose forms. Single compartment unit dose executions are especially useful in the case of paste/paste-like compostions. Multi-compartment unit dose form executions include unit dose forms comprising anhydrous liquids, especially useful compositions are those containing an organic solvent capable of remove baked-, cook- or burnt-on soils. The invention also envisages the use of anhydrous suspensions containing particulate bleach. Other forms of multi-compartment executions include a powder containing compartment in combination with a liquid containing compartment.

Unitised dose forms specially useful for use herein are pouches. The pouch herein is typically a closed structure which comprises one or more compartments, made of materials described herein. Subject to the constraints of deformability and dispenser fit, the pouch can be of any form, shape and material which is suitable to hold the composition, e.g. without allowing the release of the composition from the pouch prior to contact of the pouch to water. The exact execution will depend on, for example, the type and amount of the composition in the pouch, the number of compartments in the pouch, the characteristics required from the pouch to hold, protect and deliver or release the composition and/or components thereof.

The composition, or components thereof, are contained in the internal volume space of the pouch, and are typically separated from the outside environment by a barrier of water-soluble material. Typically, different components of the composition contained in different compartments of the pouch are separated from one another by a barrier of water-soluble material.

In the case of multi-compartment pouches, the compartments may be of a different colour from each other, for example a first compartment may be green or blue, and a second compartment may be white or yellow. One compartment of the pouch may be opaque or semi-opaque, and a second compartment of the pouch may be translucent, transparent, or semi-transparent. The compartments of the pouch may be the same size, having the same internal volume, or may be different sizes having different internal volumes.

For reasons of deformability and dispenser fit under compression forces, pouches or pouch compartments containing a component which is liquid will usually contain an air bubble having a volume of up to about 50%, preferably up to about 40%, more preferably up to about 30%, more preferably up to about 20%, more preferably up to about 10% of the volume space of said compartment.

The pouch is preferably made of a pouch material which is soluble or dispersible in water, and has a water-solubility of at least 50%, preferably at least 75% or even at least 95%, as measured by the method set out here after using a glass-filter with a maximum pore size of 20 microns.

50 grams±0.1 gram of pouch material is added in a pre-weighed 400 ml beaker and 245 ml ±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the % solubility or dispersability can be calculated.

Preferred pouch materials are polymeric materials, preferably polymers which are formed into a film or sheet. The pouch material can, for example, be obtained by casting, blow-moulding, extrusion or blow extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%.

The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000–40,000, preferably around 20,000, and of PVA or copolymer thereof, with a weight average molecular weight of about 100,000 to 300,000, preferably around 150,000.

Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1–35% by weight polylactide and about 65% to 99% by weight polyvinyl alcohol.

Preferred for use herein are polymers which are from about 60% to about 98% hydrolysed, preferably about 80% to about 90% hydrolysed, to improve the dissolution characteristics of the material.

Most preferred pouch materials are PVA films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The pouch material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

The pouch can be prepared according to methods known in the art. The pouch is typically prepared by first cutting an appropriately sized piece of pouch material, preferably the pouch material. The pouch material is then folded to form the necessary number and size of compartments and the edges are sealed using any suitable technology, for example heat sealing, wet sealing or pressure sealing. Preferably, a sealing source is brought into contact with the pouch material, heat or pressure is applied and the pouch material is sealed.

The pouch material is typically introduced to a mould and a vacuum applied so that the pouch material is flush with the inner surface of the mould, thus forming a vacuum formed indent or niche in said pouch material. This is referred to as vacuum-forming.

Another suitable method is thermo-forming. Thermo-forming typically involves the step of forming an open pouch in a mould under application of heat, which allows the pouch material to take on the shape of the mould.

Typically more than one piece of pouch material is used for making multi-compartment pouches. For example, a first piece of pouch material can be vacuum pulled into the mould so that said pouch material is flush with the inner walls of the mould. A second piece of pouch material can then be positioned such that it at least partially overlaps, and preferably completely overlaps, with the first piece of pouch material. The first piece of pouch material and second piece of pouch material are sealed together. The first piece of pouch material and second piece of pouch material can be made of the same type of material or can be different types of material.

In a preferred process, a piece of pouch material is folded at least twice, or at least three pieces of pouch material are used, or at least two pieces of pouch material are used wherein at least one piece of pouch material is folded at least once. The third piece of pouch material, or a folded piece of pouch material, creates a barrier layer that, when the sachet is sealed, divides the internal volume of said sachet into at least two or more compartments.

The pouch can also be prepared by fitting a first piece of the pouch material into a mould, for example the first piece of film may be vacuum pulled into the mould so that said film is flush with the inner walls of the mould. A composition, or component thereof, is typically poured into the mould. A pre-sealed compartment made of pouch material, is then typically placed over the mould containing the composition, or component thereof. The pre-sealed compartment preferably contains a composition, or component thereof. The pre-sealed compartment and said first piece of pouch material may be sealed together to form the pouch.

The detergent and cleaning compositions herein can comprise traditional detergency components and can also comprise organic solvents having a cleaning function and organic solvents having a carrier or diluent function or some other specialised function. The compositions will generally be built and comprise one or more detergent active components which may be selected from colorants, bleaching agents, surfactants, alkalinity sources, enzymes, thickeners (in the case of liquid, paste, cream or gel compositions), anti-corrosion agents (e.g. sodium silicate) and disrupting and binding agents (in the case of powder, granules or tablets). Highly preferred detergent components include a builder compound, an alkalinity source, a surfactant, an enzyme and a bleaching agent.

Unless otherwise specified, the components described hereinbelow can be incorporated either in the organic solvent compositions and/or the detergent or cleaning compositions.

The organic solvents should be selected so as to be compatible with the tableware/cookware as well as with the different parts of an automatic dishwashing machine. Furthermore, the solvent system should be effective and safe to use having a volatile organic content above 1 mm Hg (and preferably above 0.1 mm Hg) of less than about 50%, preferably less than about 30%, more preferably less than about 10% by weight of the solvent system. Also they should have very mild pleasant odours. The individual organic solvents used herein generally have a boiling point above about 150° C., flash point above about 100° C. and vapor pressure below about 1 mm Hg, preferably below 0.1 mm Hg at 25° C. and atmospheric pressure.

Solvents that can be used herein include: i) alcohols, such as benzyl alcohol, 1,4-cyclohexanedimethanol, 2-ethyl-1-hexanol, furfuryl alcohol, 1,2-hexanediol and other similar materials; ii) amines, such as alkanolamines (e.g. primary alkanolamines: monoethanolamine, monoisopropanolamine, diethylethanolamine, ethyl diethanolamine; secondary alkanolamines: diethanolamine, diisopropanolamine, 2-(methylamino)ethanol; ternary alkanolamines: triethanolamine, triisopropanolamine); alkylamines (e.g. primary alkylamines: monomethylamine, monoethylamine, monopropylamine, monobutylamine, monopentylamine, cyclohexylamine), secondary alkylamines: (dimethylamine), alkylene amines (primary alkylene amines: ethylenediamine, propylenediamine) and other similar materials; iii) esters, such as ethyl lactate, methyl ester, ethyl acetoacetate, ethylene glycol monobutyl ether acetate, diethylene glycol monoethyl ether acetate, diethylene glycol monobutyl ether acetate and other similar materials; iv) glycol ethers, such as ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol butyl ether and other similar materials; v) glycols, such as propylene glycol, diethylene glycol, hexylene glycol (2-methyl-2, 4 pentanediol), triethylene glycol, composition and dipropylene glycol and other similar materials; and mixtures thereof.

In the methods of the present invention for use in automatic dishwashing the detergent surfactant is preferably low foaming by itself or in combination with other components (i.e. suds suppressers). Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$–$C_{20}$, preferably $C_{10}$–$C_{18}$ linear or branched; cationic surfactants such as chlorine esters (U.S. Pat. No.

4,228,042, U.S. Pat. No. 4,239,660 and U.S. Pat. No. 4,260,529) and mono $C_6$–$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$–$C_{18}$ primary alcohols), ethoxylated-propoxylated alcohols (e.g., Olin Corporation's Poly-Tergent® SLF18), epoxy-capped poly (oxyalkylated) alcohols (e.g., Olin Corporation's Poly-Tergent® SLF18B —see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$–$C_{20}$ alkyl amine oxides (preferred amine oxides for use herein include lauryldimethyl amine oxide and hexadecyl dimethyl amine oxide), and alkyl amphocarboxylic surfactants such as Miranol™ C2M; and zwitterionic surfactants such as the betaines and sultaines; and mixtures thereof. Surfactants suitable herein are disclosed, for example, in U.S. Pat. No. 3,929,678, U.S. Pat. No. 4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of composition. Preferred surfactant for use herein are low foaming and include low cloud point nonionic surfactants and mixtures of higher foaming surfactants with low cloud point nonionic surfactants which act as suds suppresser therefor.

Builders suitable for use in detergent and cleaning compositions herein include water-soluble builders such as citrates, carbonates and polyphosphates e.g. sodium tripolyphosphate and sodium tripolyphosphate hexahydrate, potassium tripolyphosphate and mixed sodium and potassium tripolyphosphate salts; and partially water-soluble or insoluble builders such as crystalline layered silicates (EP-A-0164514 and EP-A-0293640) and aluminosilicates inclusive of Zeolites A, B, P, X, HS and MAP. The builder is typically present at a level of from about 1% to about 80% by weight, preferably from about 10% to about 70% by weight, most preferably from about 20% to about 60% by weight of composition.

Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Enzyme

Enzymes suitable herein include bacterial and fungal cellulases such as Carezyme and Celluzyme (Novo Nordisk A/S); peroxidases; lipases such as Amano-P (Amano Pharmaceutical Co.), M1 Lipase$^R$ and Lipomax$^R$ (Gist-Brocades) and Lipolase$^R$ and Lipolase Ultra$^R$ (Novo); cutinases; proteases such as Esperase$^R$, Alcalase$^R$, Durazym$^R$ and Savinase$^R$ (Novo) and Maxatase$^R$, Maxacal$^R$, Properase$^R$ and Maxapem$^R$ (Gist-Brocades); and α and β amylases such as Purafect Ox Am$^R$ (Genencor) and Termamyl$^R$, Ban$^R$, Fungamyl$^R$, Duramyl$^R$, and Natalase$^R$ (Novo); and mixtures thereof. Enzymes are preferably added herein as prills, granulates, or cogranulates at levels typically in the range from about 0.0001% to about 2% pure enzyme by weight of composition.

Bleaching Agent

Bleaching agents suitable herein include chlorine and oxygen bleaches, especially inorganic perhydrate salts such as sodium perborate mono-and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410).

Low Cloud Point Non-Ionic Surfactants and Suds Suppressers

The suds suppressers suitable for use herein include nonionic surfactants having a low cloud point. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360–362). As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., Olin Corporation's Poly-Tergent® SLF18) and epoxy-capped poly (oxyalkylated) alcohols (e.g., Olin Corporation's Poly-Tergent® SLF18B series of nonionics, as described, for example, in U.S. Pat. No. 5,576,281).

Preferred low cloud point surfactants are the ether-capped poly(oxyalkylated) suds suppresser having the formula:

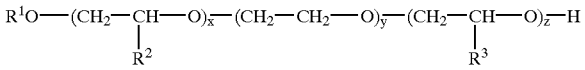

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$, may be the same or different, and is independently selected from the group consisting of branched or linear $C_2$ to $C_7$ alkylene in any given molecule; n is a number from 1 to about 30; and $R_{III}$, is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

Other suitable components herein include organic polymers having dispersant, anti-redeposition, soil release or other detergency properties invention in levels of from about 0.1% to about 30%, preferably from about 0.5% to about 15%, most preferably from about 1% to about 10% by weight of composition. Preferred anti-redeposition polymers herein include acrylic acid containing polymers such as Sokalan PA30, PA20, PA15, PA10 and Sokalan CP10 (BASF GmbH), Acusol 45N, 480N, 460N (Rohm and Haas), acrylic acidimaleic acid copolymers such as Sokalan CP5 and acrylic/methacrylic copolymers. Preferred soil release polymers herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are suitable for use herein in levels generally from about 0.005% to about 20%, preferably from about 0.1% to about 10%, more preferably from about 0.25% to about 7.5% and most preferably from about 0.5% to about 5% by weight of composition, for example diethylenetriamine penta (methylene phosphonate), ethylenediamine tetra(methylene phosphonate) hexamethylenediamine tetra(methylene phosphonate), ethylene diphosphonate, hydroxy-ethylene-1,1-diphosphonate, nitrilotriacetate, ethylenediaminotetracetate, ethylenediamine-N,N'-disuccinate in their salt and free acid forms.

The compositions herein can contain a corrosion inhibitor such as organic silver coating agents in levels of from about 0.05% to about 10%, preferably from about 0.1% to about 5% by weight of composition (especially paraffins such as Winog 70 sold by Wintershall, Salzbergen, Germany), nitrogen-containing corrosion inhibitor compounds (for example benzotriazole and benzimadazole —see GB-A-1137741) and Mn(II) compounds, particularly Mn(II) salts of organic ligands in levels of from about 0.005% to about 5%, preferably from about 0.01% to about 1%, more preferably from about 0.02% to about 0.4% by weight of the composition.

Other suitable components herein include colorants, water-soluble bismuth compounds such as bismuth acetate and bismuth citrate at levels of from about 0.01% to about 5%, enzyme stabilizers such as calcium ion, boric acid, propylene glycol and chlorine bleach scavengers at levels of from about 0.01% to about 6%, lime soap dispersants (see WO-A-93/08877), suds suppressors (see WO-93/08876 and EP-A-0705324), polymeric dye transfer inhibiting agents, optical brighteners, perfumes, fillers and clay.

Liquid detergent compositions can contain low quantities of low molecular weight primary or secondary alcohols such as methanol, ethanol, propanol and isopropanol can be used in the liquid detergent of the present invention. Other suitable carrier solvents used in low quantities includes glycerol, propylene glycol, ethylene glycol, 1,2-propanediol, sorbitol and mixtures thereof.

EXAMPLES

Abbreviations Used in Examples

In the examples, the abbreviated component identifications have the following meanings:

| | |
|---|---|
| Carbonate | Anhydrous sodium carbonate |
| STPP (anhydrous) | Sodium tripolyphosphate anhydrous |
| STPP (hydrated) | Sodium tripolyphosphate hydrated to approximately 8% |
| Silicate | Amorphous Sodium Silicate ($SiO_2$:$Na_2O$ = from 2:1 to 4:1) |
| HEDP | Ethane 1-hydroxy-1,1-diphosphonic acid |
| Perborate | Sodium perborate monohydrate |
| Percarbonate | Sodium percarbonate of the nominal formula $2Na_2CO_3.3H_2O_2$ |
| Carbonate | Anhydrous sodium carbonate |
| Termamyl | α-amylase available from Novo Nordisk A/S |
| Savinase | protease available from Novo Nordisk A/S |
| FN3 | protease available from Genencor |
| SLF18 | low foaming surfactant available from Olin Corporation |
| ACNI | alkyl capped non-ionic surfactant of formula $C_{9/11}$ $H_{19/23}$ $EO_8$-cyclohexyl acetal |
| $C_{14}AO$ | tetradecyl dimethyl amine oxide |
| $C_{16}AO$ | hexadecyl dimethyl amine oxide |
| Duramyl | α-amylase available from Novo Nordisk A/S |
| DPM | dipropylene glycol methyl ether |
| DPG | dipropylene glycol |
| Methocel | cellolosic thickener available from Dow Chemical |

In the following examples all levels are quoted as parts by weight.

Examples 1 to 4

The compositions of examples 1 to 4 are introduced in a two compartment layered PVA pouch. The dual compartment pouch is made from a Monosol M8630 film as supplied by Chris-Craft Industrial Products. 17.2 g of the particulate composition and 4 g of the anhydrous composition are placed in the two different compartments of the pouch. The deformability of the exemplified pouches, measured using and Instrom material tester (following the method described hereinabove) is 23%. The pouch is introduced in the 25 ml dispenser compartment of a Bosch Siemens 6032 dishwashing machine, the dispenser is closed and the washing machine operated in its normal 55° C. program.

| Example | 1 | 2 | 3 | 4 |
|---|---|---|---|---|
| Particulate composition | | | | |
| $C_{14}AO$ | 4.6 | 4.6 | | |
| $C_{16}AO$ | | | 4.6 | 4.6 |
| ACNI | 4.6 | | 4.6 | |
| SLF18 | | 4.6 | | 4.6 |
| STPP (anhydrous) | 27.5 | 27.5 | 27.5 | 27.5 |
| STPP (hydrated) | 27.5 | 27.5 | 27.5 | 27.5 |
| HEDP | 1.0 | 1.0 | 1.0 | 1.0 |
| Savinase | 1.3 | 0.7 | 0.7 | 1.7 |
| Termamyl | 1.7 | 0.7 | 0.7 | 1.3 |
| FN3 | 1.6 | | | 1.6 |
| Perborate | | 14.2 | | 14.2 |
| Percarbonate | 14.2 | | 14.2 | |
| Carbonate | 9.3 | 9.7 | 9.0 | 9.3 |
| Silicate | 6.4 | 6.0 | 6.7 | 6.4 |
| Perfume | 0.3 | 0.5 | 0.5 | 0.3 |
| Anhydrous composition | | | | |
| DPG | 99.5 | 95.0 | 95.0 | 99.5 |
| FN3 Liquid | | 2.60 | 2.4 | |
| Duramyl Liquid | | 2.0 | 2.4 | |
| Dye | 0.5 | 0.4 | 0.2 | 0.5 |

Examples 5 to 8

42 g of the compositions of examples 5 to 8 are introduced in a single compartment PVA pouch of 36 mm volume. The pouch is made from a Monosol M8630 film as supplied by Chris-Craft Industrial Products. The exemplified compositions are in the form of a paste having a density of 1300 kg/m$^3$. The deformability of the exemplified pouches, measured using and Instrom material tester (following the method described hereinabove) is 30%. The pouch is introduced in the 42 ml single compartment dispenser of a Whirlpool dishwashing machine, the dispenser is closed and the washing machine operated in its normal 65° C. cycle.

| Example | 5 | 6 | 7 | 8 |
|---|---|---|---|---|
| $C_{14}AO$ | 0.5 | 5.6 | | |
| $C_{16}AO$ | | | 3.6 | 0.5 |
| ACNI | 4.6 | | 4.6 | |
| SLF18 | | 5.6 | | 4.6 |
| STPP (anhydrous) | 34 | 33 | 36 | 34 |
| DPM | 45.2 | | 45.6 | 46.1 |
| DPG | | 45.5 | | |
| Savinase | | 1.7 | 1.6 | 1.6 |
| Termamyl | 1.6 | 1.6 | | |
| FN3 | 2.0 | | 1.6 | 1.0 |
| Carbonate | 10 | 10 | 10 | 10 |
| Methocel | 0.5 | 0.5 | 0.5 | 0.4 |
| Perfume | 0.5 | 0.5 | 0.5 | 0.5 |

Examples 9 to 12

50 g of the compositions of examples 9 to 12 are introduced in a single compartment PVA pouch of 36 mm volume. The pouch is made from a Monosol M8630 film as supplied by Chris-Craft Industrial Products. The exemplified compositions are in the form of a paste having a density of 1300 kg/m$^3$. The deformability of the exemplified pouches, measured using and Instrom material tester (following the method described hereinabove) is 30%. The pouch is introduced in the 42 ml single compartment dispenser of a Whirlpool dishwashing machine, the dispenser is closed and the washing machine operated in its normal 65° C. cycle.

| Example | 9 | 10 | 11 | 12 |
|---|---|---|---|---|
| $C_{14}AO$ | 1.2 | | | |
| $C_{16}AO$ | | 1.2 | 1.1 | |
| ACNI | 1.1 | 1.1 | | |
| SLF18 | | | 1.1 | |
| LF404 | | | | 2.3 |
| STPP (anhydrous) | 34 | 34 | 34 | 34 |
| Silicate | 8 | 8 | 8 | 8 |
| HEDP | 0.7 | 0.7 | 0.7 | 0.7 |
| Percarbonate | 10 | 10 | 10 | 10 |
| DPM | 30 | | 30 | |
| DPG | | 30 | | 30 |
| Savinase | 0.5 | 0.5 | 0.5 | 0.5 |
| Termamyl | 0.5 | | | 0.5 |
| FN3 | | 0.5 | 0.5 | |
| Carbonate | 13 | 13 | 13 | 13 |
| Methocel | 0.5 | 0.5 | 0.5 | 0.4 |
| Perfume | 0.5 | 0.5 | 0.5 | 0.5 |

What is claimed is:

1. A method of washing dishware/tableware in an automatic dishwashing machine having a single or multi-compartment product dispenser which is normally closed and sealed after charging said machine and prior to delivery of a dishwashing product into the wash liquor and wherein said dishwashing product comprises one or more dishwashing compositions in a unit dose form having a degree of deformability greater than about 10% and a shape and size such that said dishwashing product occupies more than about 60% of the volume of the corresponding compartment of said product dispenser in its closed state, said method comprising the step of contacting said dishware/tableware with said dishwashing product.

2. A method according to claim 1 wherein the volume of said product dispenser compartment in its closed state is in the range from about 15 to about 70 ml.

3. A method according to claim 1 wherein said dishwashing product comprises a dose sufficient for a single wash cycle of an anhydrous dishwashing composition.

4. A method according to claim 3 wherein the one or more dishwashing composition comprises an organic solvent system effective in removing cooked-, baked- and burnt-on soils.

5. A method according to claim 4 wherein said organic solvent system is selected from alcohols, amines, esters, glycol ethers, glycols, terpenes, and mixtures thereof.

6. A method according to claim 4 wherein said organic solvent system is selected from the group consisting of organoamine solvents, alcoholic solvents, glycols, glycol derivatives, and mixtures thereof; wherein said organoamine solvents are selected from the group consisting of alkanolamines, alkylamines, alkyleneamines, and mixtures thereof; wherein said alcoholic solvents are selected from the group consisting of aromatic alcohols, aliphatic alcohols, cycloaliphatic alcohols, and mixtures thereof; and wherein said glycols and glycol derivatives are selected from the group consisting of $C_2$–$C_3$ (poly)alkylene glycols, glycol ethers, glycol esters, and mixtures thereof.

7. A method according to claim 6 wherein said organic solvent comprises organoamine solvent and glycol ether solvent in a weight ratio of from about 3:1 to about 1:3.

8. A method according to claim 7 wherein said glycol ether solvent is selected from the group consisting of ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol monobutyl ether, dipropylene glycol monobutyl ether, ethylene glycol phenyl ether, and mixtures thereof.

9. A method according to claim 3 wherein said anhydrous dishwashing composition is in the form of a particulate bleach suspension in a non-aqueous liquid carrier.

10. A method according to claim 9 wherein said non-aqueous liquid carrier has:

i) a fractional dispersion Hansen solubility parameter greater than about 40%; and ii) a fractional polar Hansen solubility parameter less than about 60%.

11. A method according to claim 9 wherein said particulate bleach is selected from the group consisting of inorganic peroxides, organic peracids, and mixtures thereof; wherein said inorganic peroxides are selected from the group consisting of perborates, percarbonates, and mixtures thereof; and wherein said organic peracids are preformed monoperoxy carboxylic acids.

12. A method according to claim 9 wherein said particulate bleach has an average particle size from about 10 $\mu$m to about 500 $\mu$m.

13. A method according to claim 9 wherein the density difference between said particulate bleach and said anhydrous system is less than about 500 Kg/m$^3$.

14. A method according to claim 3 wherein said anhydrous dishwashing composition comprises a detergency enzyme.

15. A method according to claim 3 wherein said anhydrous dishwashing composition comprises an alkalinity source.

16. A method according to claim 3 wherein said anhydrous dishwashing composition is in liquid paste or gel form having a viscosity of from about 1,000 Kg/m s$^{-1}$ to about 100,000 Kg/m s$^{-1}$ at shear rate of 1 s$^{-1}$; and from about 500 Kg/m s$^{-1}$ to about 50,000 Kg/m s$^{-1}$ at shear rate of 150 s$^{-1}$ as measured using a Contraves Rheometer with 40 mm diameter parallel plate at 25° C.

17. A method according to claim 1 wherein the one or more dishwashing composition is in the form of a paste having a density greater than about 1100 Kg/m$^3$.

18. A method according to claim 1 wherein said dishwashing product is in the form of a pouch.

19. A method according to claim 18 wherein said pouch is water soluble.

20. A method according to claim 19 wherein said pouch is a single or multi-compartment pouch.

21. A method according to claim 20 wherein the compartments of said multi-compartment pouch have different rates of solubility in water under given temperature conditions.

22. A method according to claim 20 wherein said multi-compartment pouch comprises at least one compartment containing a powder composition.

23. A method according to claim 22 wherein said powder composition comprises a particulate bleach.

24. A method according to claims 20 wherein said multi-compartment pouch comprises at least one compartment containing a liquid composition.

25. A method according to claim 24 wherein said liquid composition comprises a non-ionic surfactant.

26. A method according to claim 1 wherein said unit dose dishwashing product displays anisotropic deformability.

* * * * *